US005642702A

United States Patent [19]

Kouchi et al.

[11] Patent Number: 5,642,702

[45] Date of Patent: Jul. 1, 1997

[54] GENERATOR SET

[75] Inventors: Toshifumi Kouchi; Tadafumi Hirose; Yoshio Tanaka, all of Wako, Japan

[73] Assignee: Honda Giken Kogyo Kabushiki Kaisha, Tokyo, Japan

[21] Appl. No.: 682,098

[22] Filed: Jul. 17, 1996

[30] Foreign Application Priority Data

Jul. 21, 1995 [JP] Japan ..... 7-207794

[51] Int. Cl.[6] ..... F02B 77/00

[52] U.S. Cl. ..... 123/198 E; 123/2; 181/204

[58] Field of Search ..... 123/198 E, 2; 181/204; 290/1 A

[56] References Cited

FOREIGN PATENT DOCUMENTS 2-5897 2/1990 Japan .
8-291718 11/1996 Japan .

*Primary Examiner*—Noah P. Kamen

*Attorney, Agent, or Firm*—Frishauf, Holtz, Goodman, Langer & Chick

[57] ABSTRACT

A generator set includes a permanent soundproof housing for housing a portable engine generator therein. The portable engine generator has wheels for moving the same and can be operated in the permanent soundproof housing. The portable engine generator can be taken out of the permanent soundproof housing by pulling the portable engine generator out of the permanent soundproof housing in a direction transverse to a direction of advance of the wheels, and thereafter moving the portable engine generator in the direction of advance of the wheels.

13 Claims, 9 Drawing Sheets

GENERATOR SET

BACKGROUND OF THE INVENTION

1. Field of the Invention

This invention relates to an engine generator set which serves as a power source for supplying electric power to road facilities, such as traffic signals, and outdoor work facilities, and as one for emergency purposes during failure of mains power.

2. Prior Art

Conventionally, engine-driven generators (hereinafter referred to as "engine generators") are generally employed as a generator set of this kind. Such engine generators are used for supplying electric power to road facilities, such as traffic signals and outdoor work facilities. They are likely to be constantly exposed to weather, sunlight, dust, etc. Therefore, the engine generators are required to be constructed so as to endure service environmental conditions such as weather over a long term.

Further, an engine generator is often used as a power source for night work operations, and therefore are required to have reduced noise.

To comply with the above-mentioned requirements, the present assignee proposed "SOUNDPROOF ENGINE-DRIVEN WORKING MACHINE" (Japanese Patent Publication (Kokoku) No. 2-5897). As shown in FIGS. 8 and 9, the proposed soundproof engine-driven working machine is comprised of a soundproof casing 1, an engine 31 received in a lower portion of the soundproof casing 1, and a generator 41 received in an upper potion of the same and driven by the engine 31.

The soundproof casing 1 includes upper doors 11, 13 and lower doors 12, 14 provided respectively on front and rear sides thereof, and wire mesh doors 15, 17 provided respectively inside the lower doors 12, 14. When the engine-driven working machine is not operating, the upper and lower doors 11 to 14 are closed, whereas when it is operating, as shown in FIGS. 9 and 10, the lower doors 12, 14 are opened for ventilation, i.e. for introducing intake air to be supplied to the engine and discharging exhaust gases emitted from the engine, as well as for cooling the inside of the soundproof casing 1. This soundproof engine-driven working machine can endure severe environmental conditions for a long term by holding the upper and lower doors 11 to 14 closed when it is not operating.

However, since the proposed soundproof engine-driven working machine is operated with the lower doors 12, 14 held open for introducing intake air from the outside and discharging exhaust gases to the same as well as for cooling the inside of the soundproof casing 1, the lower doors 12, 14 have to be opened first by hand before putting the machine into operation. Therefore, it is practically impossible to automatically start the machine or operate the same by remote control when the power fails. Especially when the engine-driven working machine is installed at a remote place, one has to waste for a considerable time period before the machine is started.

Further, when electric power is supplied to a working site far from the location of the soundproof engine-driven working machine, it is required to lay a cable over a long distance. In such a case, it takes much labor and time in handling the cable, and a significant voltage drop across the long cable results in a decrease in the maximum power available from the engine-driven working machine.

In view of these problems, the present assignee has already proposed a generator set in Japanese Patent Application No. 7-94836, which is constructed such that a portable engine generator can be operated not only in a state accommodated or received within a permanent soundproof housing thereof, but also in a state separate from the housing as a single unit.

However, the generator set or the engine-driven working machine discussed above is often installed in a limited space, e.g. between roadside trees or flower beds along a sidewalk adjacent to a roadway so as to keep it out of the way of passersby. This makes it difficult to secure a sufficient space for the operation of taking the portable engine generator out of the soundproof casing when it has to be operated outside the housing.

SUMMARY OF THE INVENTION

It is the object of the invention to provide a generator set which permits a soundproof portable engine generator thereof to be operated in a state accommodated within a permanent soundproof housing thereof, and at the same time requires only a small space for carrying out the operation of taking the engine generator out of the housing to operate the same outside the housing as a single unit.

To attain the above object, the present invention provides a generator set comprising:

- a portable engine generator having wheels for moving the portable engine generator;
- a permanent soundproof housing for housing the portable engine generator in a manner such that the portable engine generator can be operated therein; and
- generator takeout means for taking the portable engine generator out of the permanent soundproof housing by permitting the portable engine generator to be pulled out of the permanent soundproof housing in a direction transverse to a direction of advance of the wheels, and thereafter permitting the portable engine generator to move in the direction of advance of the wheels.

Preferably, the generator takeout means comprises a truck on which the portable engine generator is placed, the truck being received in the permanent soundproof housing in a manner such that the truck is movable in the direction transverse to the direction of advance of the wheels to allow pulling out of the permanent soundproof housing, and a door having an inner surface and provided in the permanent soundproof housing in a manner such that it can be opened by being downwardly rotated into a horizontal position, whereby the portable engine generator is made movable in the direction of advance of the wheels when the portable engine generator is pulled out of the permanent soundproof housing onto the inner surface of the door in the horizontal position.

More preferably, the generator takeout means includes rails provided on the truck for receiving the wheels of the portable engine generator therein to guide the wheels in the direction of advance of the wheels.

Preferably, the generator set according to claim 1, includes a soundproof casing having a top, in which the portable engine generator is housed, the soundproof casing having an exhaust duct for discharging exhaust air, and the permanent soundproof housing has an exhaust port formed therein and opening into an outside thereof, and a communication duct communicating with the exhaust port, the exhaust duct of the portable engine generator and the communication duct of the permanent soundproof housing being disposed to communicate with each other in a tightly-connected fashion when the portable engine generator is received in the permanent soundproof housing and fixedly positioned therein.

Further preferably, the exhaust duct of the portable engine generator is formed in the soundproof casing in a fashion projecting out of the top of the soundproof casing, the exhaust duct having a cross-section progressively reduced in width in a direction opposite to the direction transverse to the direction of advance of the wheels in which the portable engine generator is pulled out of the permanent soundproof housing, the communication duct of the permanent soundproof housing having a cross-section substantially similar in shape to the cross-section of the exhaust duct, the exhaust duct and the communication duct being brought into engagement with each other when the portable engine generator is pushed into the permanent soundproof housing, to thereby permit positioning of the wheels in the direction of advance of the wheels.

More preferably, the truck has front and rear ends as viewed in the direction of advance of the wheels, the generator takeout means including contact members provided respectively on the front and rear ends of the truck, and guide members provided in the permanent soundproofing housing and disposed to be brought into contact with respective ones of the contact members, the guide members guiding respective ones of the contact members in the direction transverse to the direction of advance of the wheels as the portable engine generator is pulled out of the permanent soundproof housing.

Further preferably, the generator set includes running boards formed separately from the rails, for guiding the portable engine generator having been pulled out onto the inner surface of the door, to an outside of the generator, as the portable engine generator is moved in the direction of advance of said wheels.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
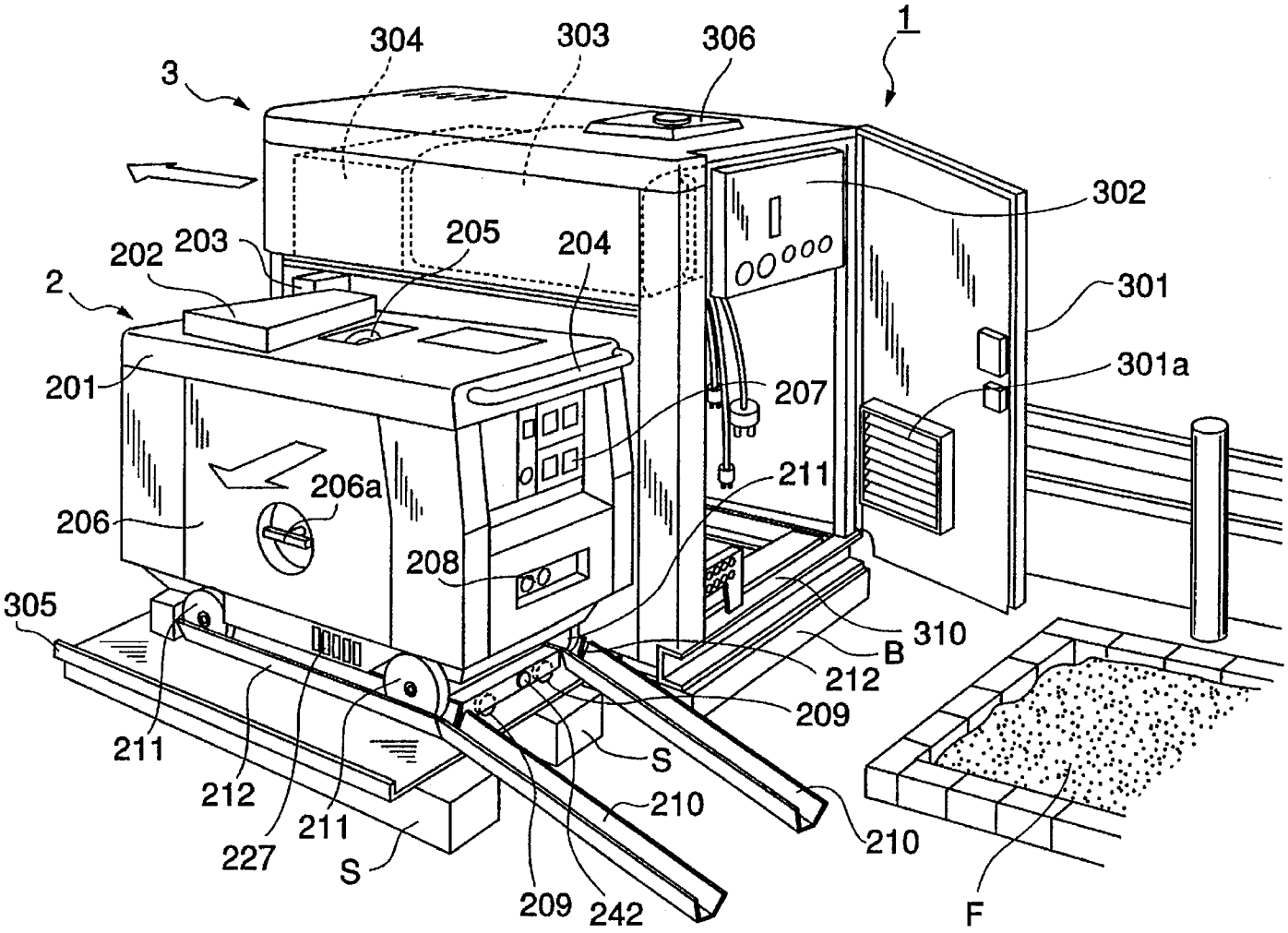
FIG. 1 is a perspective view showing a generator set in a state in which a portable engine generator thereof is being taken out of a permanent soundproof housing thereof, according to an embodiment of the invention.

Referring first to FIG. 1, reference numeral 1 designates a generator set according to an embodiment of the invention, which is comprised of a permanent soundproof housing (hereinafter referred to as "the housing") 3, a soundproof portable engine generator (hereinafter referred to as "the engine generator") 2 which can be operated not only in a state accommodated or received in the housing 3, but also as a single unit in a state separate from the housing 3. FIG. 1 shows a state in which the engine generator 2 is being taken out of the housing 3.

As shown in the figure, the generator set 1 is placed between flower beds (one of which is shown) along a sidewalk of a road such that the longitudinal axis of the generator set is parallel to the road, and there is only a small space left between the generator set and the flower beds. When the generator set 1 is installed as shown in the figure, it is impossible to take out the engine generator 2 from a side thereof opposed to the flower bed by opening a front door panel 301 as shown in the figure. To overcome this inconvenience, the generator set 1 is constructed such that the engine generator 2 can be first pulled out of the housing 3 toward the center of the sidewalk and then moved along a side of the housing 3 (in a direction of advance of wheels 211 of the engine generator 2, i.e. along the sidewalk).

Next, details of the construction of the generator set will be described with respect to individual component parts thereof.

The housing 3 is in the form of a box rectangular in shape as viewed in a plan view, and fixed to a bed plate B, with its inner wall surfaces covered with a soundproofing material. Provided on a front side of the housing 3 is a front door panel 301 which is a single swing type equipped with a lock. The front door panel 301 is formed with a cooling air intake opening 301*a*. Provided on a front wall exposed when the front door panel 301 is opened is an automatic starter (ATS) 302 for detecting failure of commercial power to automatically start the engine generator 2. The housing 3 incorporates a main fuel tank 303 at a top portion thereof. The main fuel tank 303 has a locked filler opening 306 formed in a top wall thereof in a fashion slightly projecting out of the top wall surface of the housing 3. Provided behind the main fuel tank 303 is a communication duct 304. Further, the housing 3 has a cooling air outlet 311 formed through an upper portion of a rear end wall thereof (see FIGS. 5 to 7).

Figure 4:
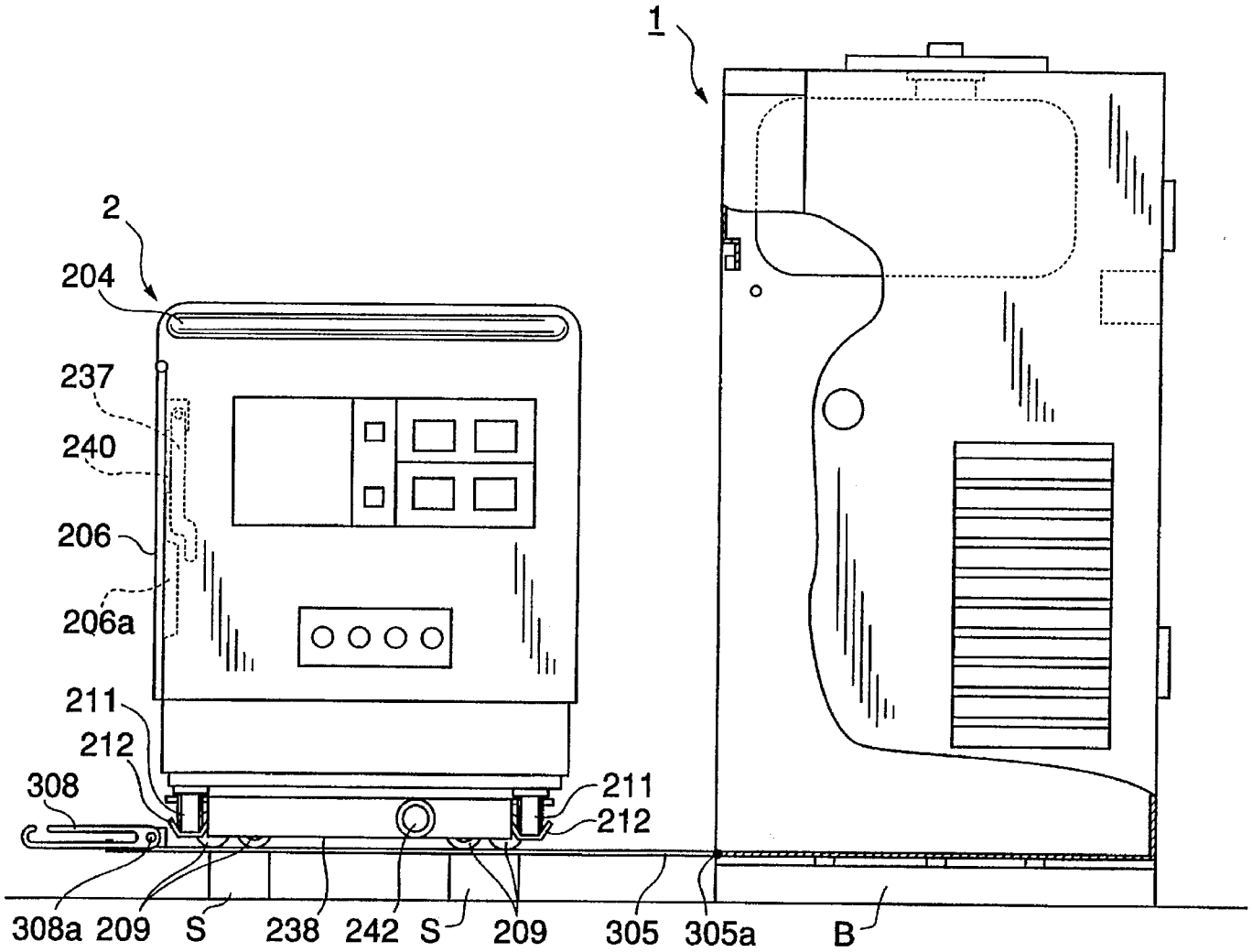
FIG. 4 is a right side elevational view, partly in section, showing the generator set in a state in which the portable engine generator is being taken out of the permanent soundproof housing.

On a left side (sidewalk side) of the housing 3, there is provided a side door 305 which is hinged at a bottom edge thereof such that it can be opened by downwardly rotating toward the operator about the hinged bottom edge. The side door 305, which is originally or conventionally provided for inspection of the engine generator 2, is utilized in the present embodiment for once pulling the engine generator 2 laterally (toward the center of the sidewalk) out of the housing 3 after opening the side door 305 to a level position in which it is continuous with the bottom of the housing 3, as best illustrated in FIG. 4.

The portable engine generator 2 is an engine generator housed in a soundproof casing (hereinafter referred to as "the casing") 201 (see FIG. 2). The casing 201 is in the form of a box rectangular in shape as viewed in a plan view, and has the four wheels 211 attached to the bottom thereof. The wheels 211 are received in guide rails 212 mounted integrally on a truck 238 (see FIG. 3), referred to hereinafter. Reference numeral 210 designates running boards with the aid of which the engine generator 2 is moved down along a longitudinal axis of the housing 3 from the side door 305 onto the sidewalk after once being laterally pulled out of the housing 3 onto the side door 305, as best illustrated in FIG. 1. The running boards 210 have substantially the same shape as the guide rails 212.

Provided on a left side (sidewalk side) of the casing 201 is an inspection door 206 for carrying out maintenance/inspection of the engine generator 2 in a state housed in the casing 201. The inspection door 206 is hinged at a top edge thereof such that it can be opened by lifting a lower edge thereof to rotate about the hinged top edge, and is equipped with a lock 206*a*.

The casing 201 is provided with handles 204 at respective top portions of front and rear ends thereof for moving the engine generator 2 by gripping the handles 204 by hands. An operating panel 207 having an output power-indicating meter, etc. arranged thereon is mounted in a recess formed in a front end wall of the casing 201, and a fuel-selecting panel 208 is mounted below the operating panel 207 for changing over a fuel supply source between the main fuel tank 302 and an internal fuel tank 215 (see FIG. 2), referred to hereinafter. Further, a duct-connecting member 202, which is trapezoidal in shape as viewed in a plan view and open at the top and the bottom is provided in a fashion projecting from the top wall of the casing 201, and an exhaust duct 203 in the form of a box which is open at the bottom and on the driveway side is provided in a fashion projecting from a right side (roadway side in FIG. 1) portion of the top wall of the casing 201 immediately behind the duct-connecting member 202.

Reference numeral 209 designates wheels of the truck 238, and reference numeral 242 balls which slide on frames 310 (see FIG. 5) provided at the bottom of the housing 3 to guide the engine generator 2, when the engine generator 2 is laterally pulled out of the housing 3.

Figure 2:
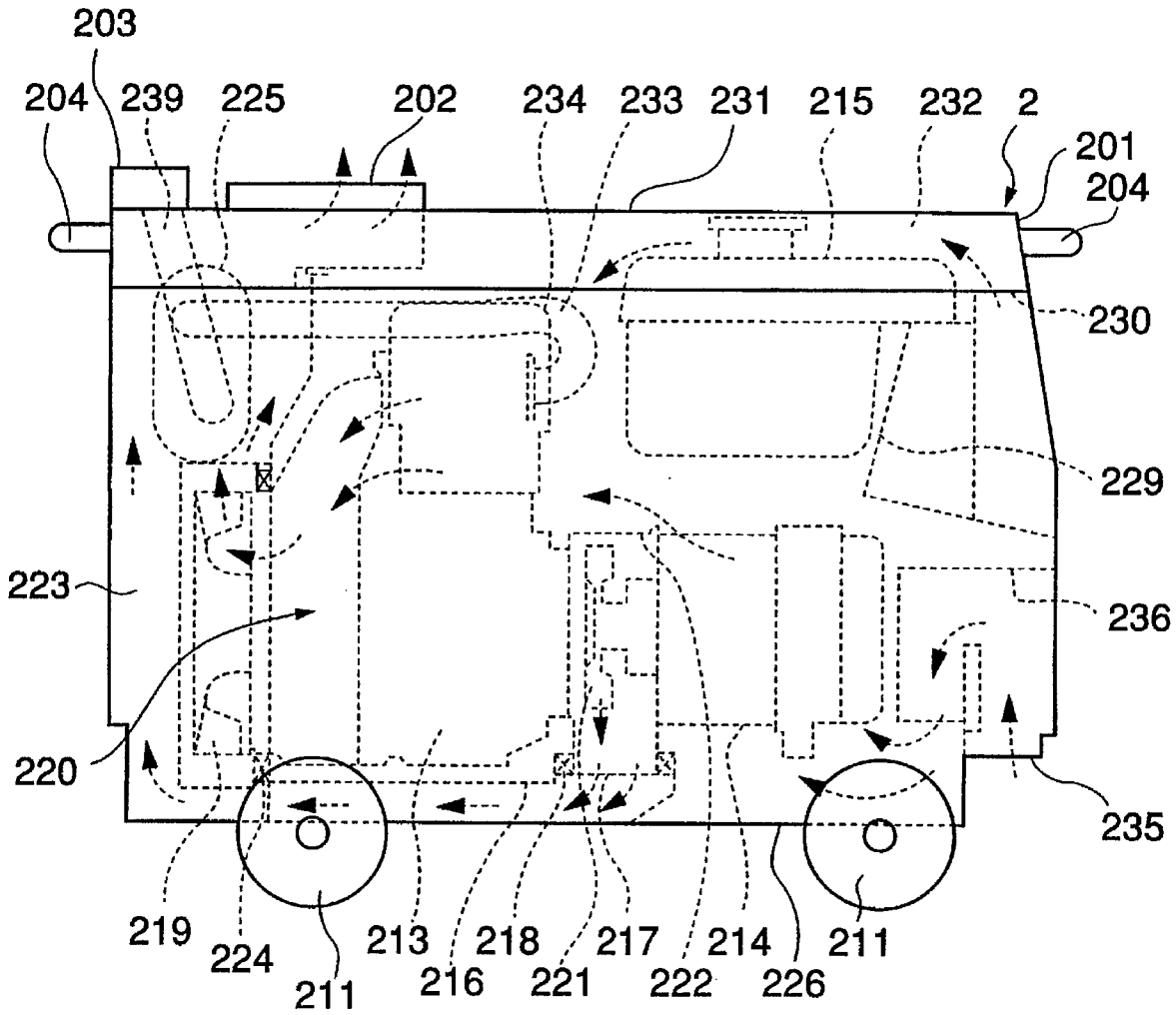
FIG. 2 is a side view schematically showing the internal construction of the portable engine generator.

FIG. 2 shows the internal construction of the engine generator 2. In the figure, reference numeral 213 designates an engine (diesel engine) 213 housed in the casing 201, which is connected to a generator (synchronous generator) 214. The engine 213 has an output shaft, not shown, which extends along the same axis as a rotational shaft, not shown, of the generator 214.

An exhaust duct 216 extends along a longitudinal axis of the casing 201 between the bottom of the engine 213 and a bottom panel 226 of the casing 201. The exhaust duct 216 has an air-inlet end thereof connected to a generator duct cover 217 mounted at a rear end of the generator 214, by way of a seal rubber 218.

A cooling fan 219 is mounted at a rear end of the engine 213, which is driven for rotation by the output shaft thereof, and enclosed within an engine duct 220. On the other hand, a cooling fan 221 is arranged at a rear end of the generator 214, and enclosed within a fan cover 222 associated with the generator duct cover 217.

The engine duct 220 opens into an exhaust chamber 223 defined between the engine 213 and a rear end wall 201R of the casing 201, with a seal rubber 224 being mounted between the engine duct 220 and a partition wall partly defining the exhaust chamber 223. Further, a muffler 225 is arranged at an upper location within the exhaust chamber 223 for muffling noise emitted from the engine 213.

Formed in both sides of the bottom panel 226 are side air intake openings 227 (see FIG. 1), which communicate with side ducts, not shown, extending longitudinally between corners of the front and rear sides of the casing 201. The side ducts have air-outlet ends opening toward the bottom of the engine 213.

The internal fuel tank 215 is in the form of a rectangular parallelepiped and arranged at an upper location within the casing 201. The fuel tank 215 fully extends between opposite side walls of the casing 201, with a front end thereof being located at an upper end of a box 229 housing the operating panel 207 and a rear end thereof being located longitudinally at a substantially central location of the casing 201. The casing 201 has an upper air inlet port 230 formed through a top wall of the recess of the front end wall of the casing 201, and located in front of the internal fuel tank 215. The upper air inlet port 230 communicates with a space between the top wall of the internal fuel tank 215 and a top panel 231 of the casing 201. This space forms a duct-like ventilation passage 232 which extends from an air-outlet end of the upper air inlet port 230 and has an air-outlet end thereof opening toward a top portion of the engine 213 including a first exhaust pipe 233, an air cleaner 234, etc.

A lower air inlet port 235 is formed through a front end of the bottom panel 226 and communicates with an air-guide duct 236 which is substantially inverted U-shaped in longitudinal section. The air-guide duct 236 has an air-outlet end opening into a space below a front end of the engine generator 214. A cooling air intake port, not shown, is provided through the front end of the generator 214 for supplying cooling air into the inside of the generator 214. The top of the exhaust chamber 223 communicates with a hollow space within the duct-connecting member 202 projecting from the top panel 231.

Next, flows of air flowing through the casing 201 will be described. Fresh air or cooling air drawn from the lower air inlet port 235 flows through the air-guide duct 236 to the engine generator 214 to be taken into the generator 214 via the cooling air intake port formed through the front end thereof by a drawing force created by the operation of the cooling fan 221. The cooling air cools the inside of the generator 214 and then flows through the exhaust duct 216 into the exhaust chamber 223, where it cools the muffler 225, and then flows out through the duct-connecting member 202 to the outside.

On the other hand, fresh air introduced via the upper air inlet port 230 is drawn into the duct-like ventilation passage 232 by a drawing force created by the operation of the cooling fan 219 connected to the engine 213 to flow downward in a falling fashion along a rear end of the internal fuel tank 215 to the engine 213 located below the ventilation passage 232. The air is drawn by the cooling fan 219 into the engine 213 to cool the engine 213 and flows into the exhaust chamber 223 via the engine duct 220. The seal rubber 224 connecting the engine duct 220 to the partition wall of the exhaust chamber 223 absorbs vibrations of the engine 213.

Fresh air introduced via the side air intake openings 227 is also drawn to the engine 213 via the side ducts, and flows through the engine duct 220 into the exhaust chamber 223 as described above. Cooling air around the generator 214, which is not drawn into the generator 214, is also drawn by the operation of the cooling fan 219 of the engine 213, which is capable of drawing a large quantity of air, to thereby cool the engine 213 and flow into the exhaust chamber 223.

Next, a mechanism for taking the engine generator 2 out of the housing 3 will be described in detail with reference to FIGS. 3 to 7.

Figure 3:
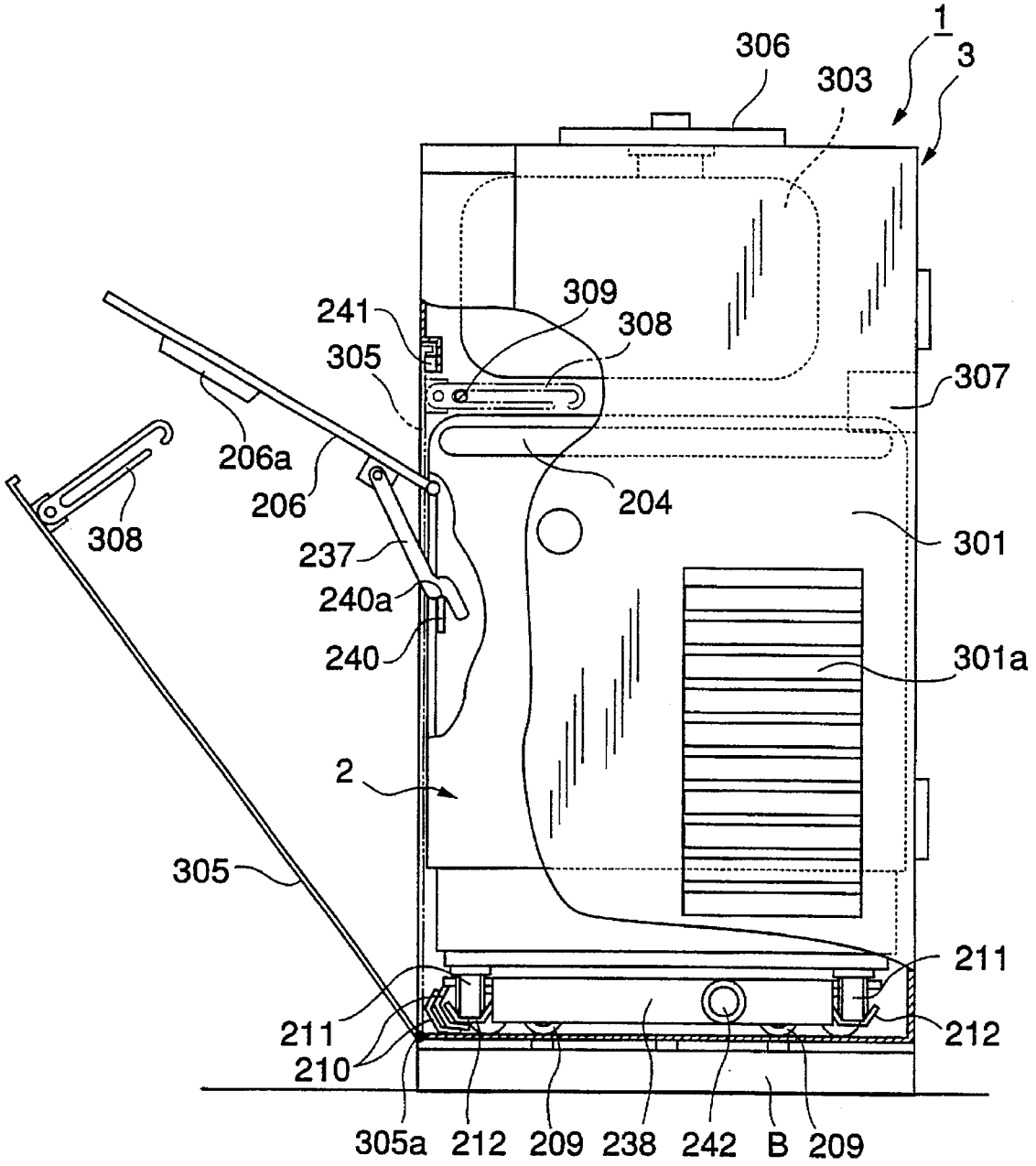
FIG. 3 is a right side elevational view, partly in section, showing the generator set in a state in which the portable engine generator is accommodated within the permanent soundproof housing.

Referring first to FIG. 3, on the left side (sidewalk side) of the housing 3, the side door 305 has its bottom edge connected to the housing 3 by a hinge 305*a* such that the side door 305 can be opened by downwardly rotating the same about the hinge 305*a* to thereby form a wide floor continuous with the inner bottom surface of the housing 3. The side door 305 is formed with a door hook 308 on an inner side of an upper end portion thereof (as viewed in its upright position). After engaging the door hook 308 via its hooking opening with an engaging member 309 (see FIG. 5) provided on the housing 3 at a location opposed to the door hook 308, the door hook 308 can be pushed into a position indicated by broken lines in FIG. 3, to thereby close the side door 305. When the side door 305 is closed, an inwardly bent flange formed on the top of the side door 305 is caught by a clip 241 provided on the housing 3 at a location corresponding to the inwardly bent flange of the side door 305, and in this state, the side door 305 is locked with a lock, not shown, to hold the same in a closed or upright position.

On the other hand, to open the side door 305, the lock is unlocked to allow the side door 305 to fall to a position in which the door hook 308 becomes engaged with the engaging member 309. In this state, the engaging member 309 can be removed from the door hook 308 using the hooking opening of the door hook 308, and then the side door 305 is lowered to its horizontal position.

To inspect the engine generator 2, the inspection door 206 is opened which is provided on the left side (sidewalk side) of the engine generator 2. More specifically, since the inspection door 206 is hinged at its top edge to the casing 201, it can be opened by lifting its bottom upward to upwardly rotate the door 206 about the hinged top edge. During this opening motion, a front end of a shift arm 237 provided at an inner wall of the inspection door 206 slides along a guide groove 240 provided in the casing 201, until a shouldered portion of the shift arm 237 is inserted into an engaging recess 240*a* formed in the guide groove 240, whereby the inspection door 206 can be held in an open state.

The engine generator 2 is placed on the truck 238. The truck 238 has the four wheels 209 attached thereto at respective locations in the vicinity of the front and rear ends of the truck 238 such that they can roll in lateral directions, i.e. in directions orthogonal to the sidewalk. On both sides of the truck 238, guide rails 212 substantially U-shaped in cross-section are formed integrally with the truck 238 and extend along a longitudinal axis of the truck 238, for guiding the wheels 211 attached to the engine generator 2. That is, the engine generator 2 is placed on the truck 238 such that the wheels 211 thereof are received in the guide rails 212 of the truck 238.

Further, the balls 242 are embedded in the front and rear ends of the truck 238. The two running boards 210 are received in the housing 3 on the inner bottom surface thereof along a left-side guide rail 212 of the truck 238.

In pulling the engine generator 2 out of the housing 3 to use the same separately as a single unit, the side door 305 is opened into a position shown in FIG. 4, and spacers S are inserted under the side door 305 to set the side door 305 substantially at the same level with the inner bottom surface of the housing 3. Then, the engine generator 2 is moved out of the housing 3 toward the operator onto the side door 305 utilizing the truck 238. When the engine generator 2 is being pulled out of the housing 3, the balls 242 are brought into contact with the frames 310 (see FIG. 5) provided at the bottom of the housing 3 and guided thereby. This sets the direction of movement of the engine generator 2 to thereby prevent undesired loose movements of the engine generator 2, which facilitates the pulling of the engine generator 2 out of the housing 3. The extreme position of the engine generator 2 moved in the lateral or pulling direction is limited by a stopper, not shown, which is formed on an inner side surface of an upper portion of the side door 305 as viewed in its upright position.

In the present embodiment, it is expected that the spacers S are provided in advance at locations at which they are invisible to passersby, e.g. at a side (roadway side) of the generator set 1 remote from the operator or the sidewalk. This is however not limitative, but the spacers may be housed in the truck 238 similarly to the running boards 210, making it possible to prevent the spacers from being stolen to ensure use of them when they are needed.

Figure 5:
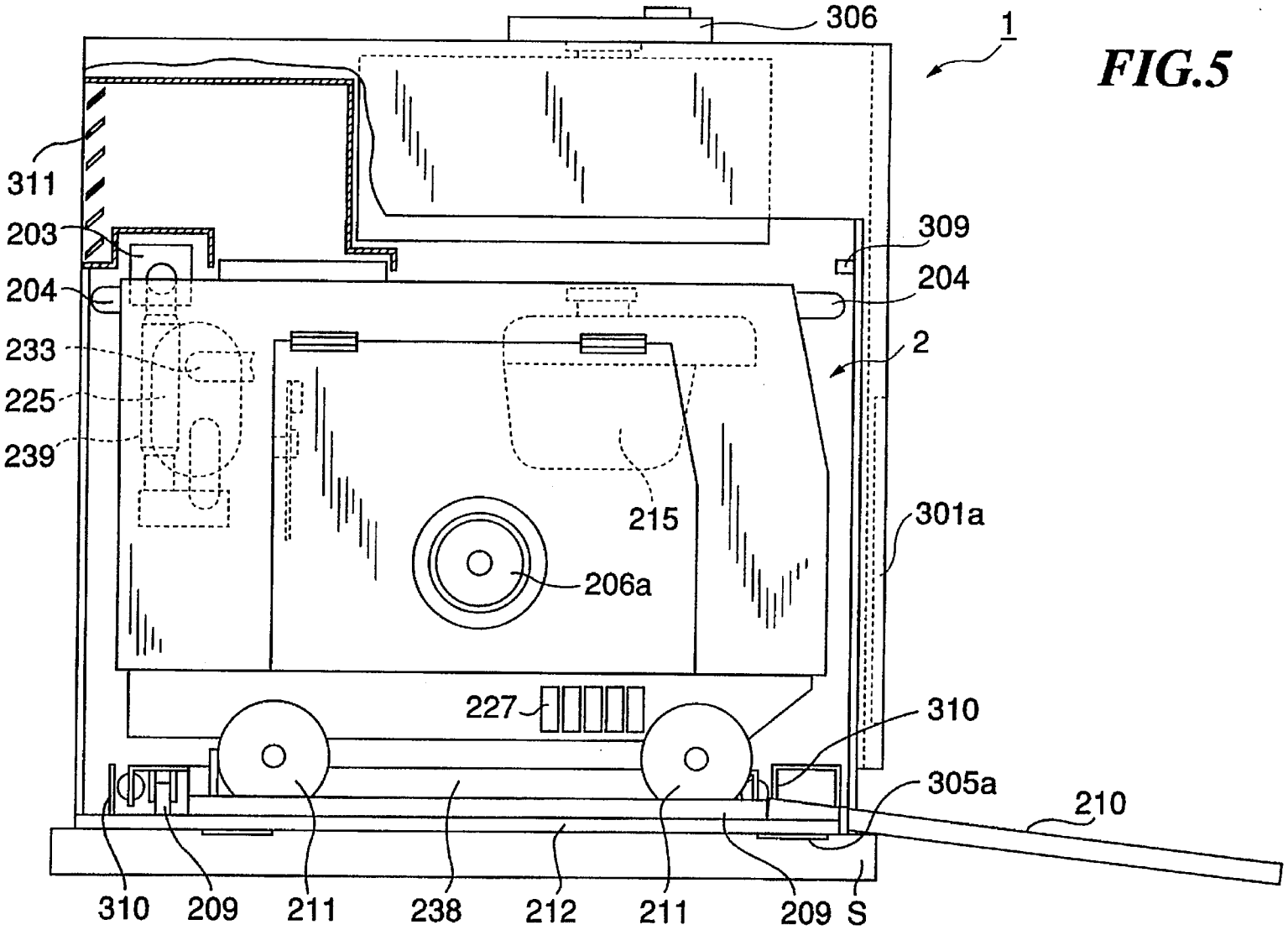
FIG. 5 is a front elevational view, partly in section, showing the generator set in a state in which the portable engine generator is being taken out of the permanent soundproof housing.
Figure 6:
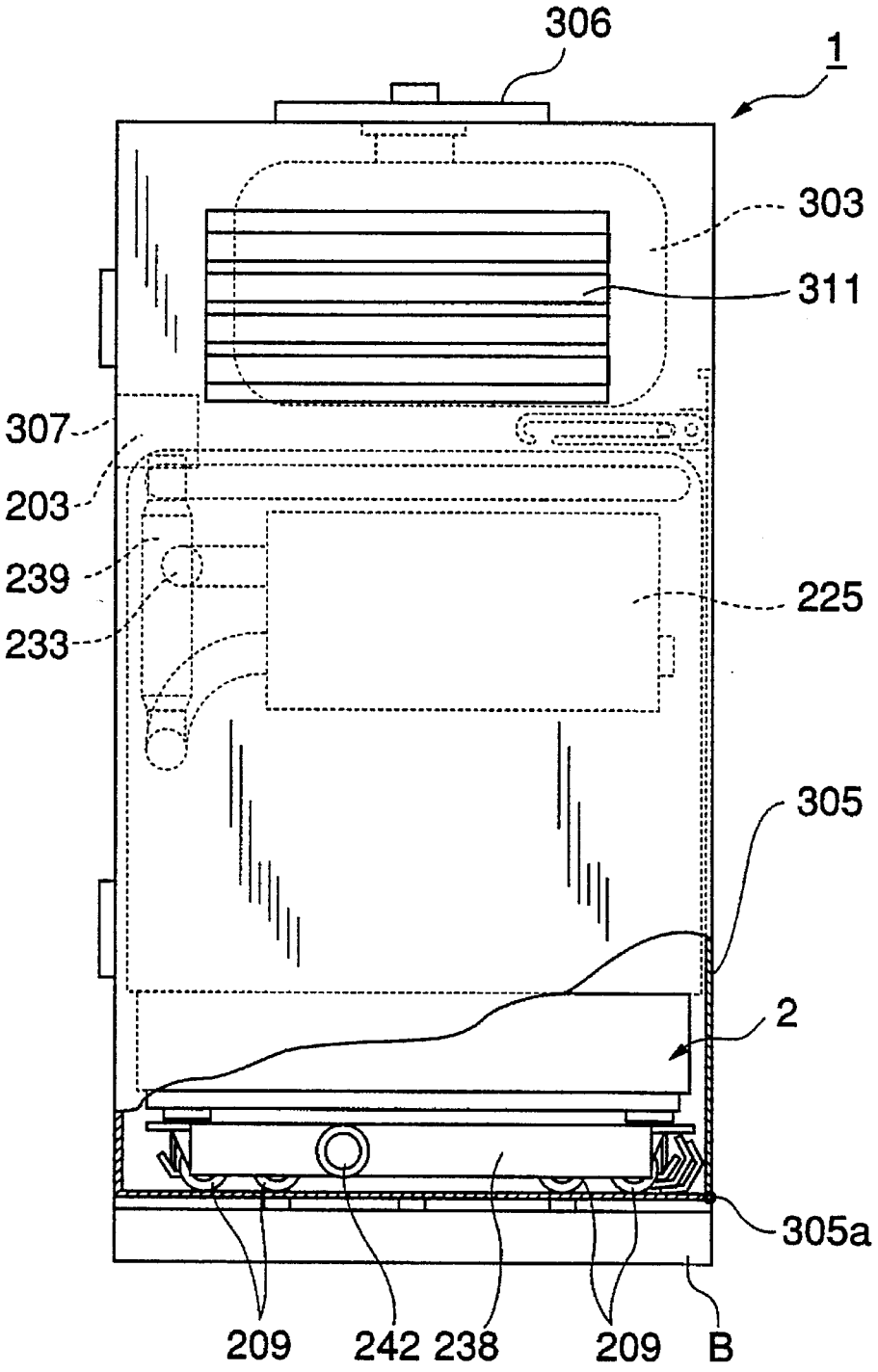
FIG. 6 is a left side elevational view, partly in section, showing the generator set.

After the engine generator 2 is moved onto the side door 305 by utilizing the truck 238, the two running boards 210 housed beside the left-side guide rail 212 are taken out and connected to the guide rails 212 (see FIGS. 1 and 5).

In this case, as shown in FIG. 1, a front end of each running board 210 overlaps the flower bed F in the direction of advance of the engine generator 2. Therefore, if an attempt is made to directly pull the engine generator 2 out of the housing 3 via the front side by opening the front door panel 301 without moving the engine generator 2 onto the side door 305, the engine generator 2 collides against the flower bed F. Therefore, it is actually impossible to pull the engine generator 2 out of the housing 3 via the front side. However, in the present embodiment, the engine generator 2 is laterally moved together with the guide rails 212 onto the side door 305 in a horizontal open position, and then the running boards 210 are connected to the guide rails 212 of the truck 238 carrying the engine generator 2. Accordingly, the running boards 210 do not overlap the flower bed F in the direction of advance of the wheels 211. This prevents the engine generator 2 from colliding against the flower bed F when it is brought down from the side door 305 by the use of the running boards 210. That is, even if the generator set 1 is placed in a small space, such as between road trees and flower beds, to keep it out of the way of passersby, the engine generator 2 can be taken out of the housing 3. In other words, it is possible to operate the engine generator 2 in a state received within the housing 3, while requiring a small space for the operation of taking the engine generator 2 out of the housing 3 to operate it separately as a single unit.

Further, since the engine generator 2 can be easily moved onto the side door 305 by the use of the truck 238, the wheels 211 of the engine generator 2 are received in the guide rails 212 in advance, and the two running boards 210 are housed adjacent to the guide rails 212, the operation of taking out the engine generator 2 can be smoothly carried out and completed in a short time period.

Next, a duct-connecting mechanism provided between the engine generator 2 and the permanent soundproofing housing 3, etc. will be described in detail.

Figure 7:
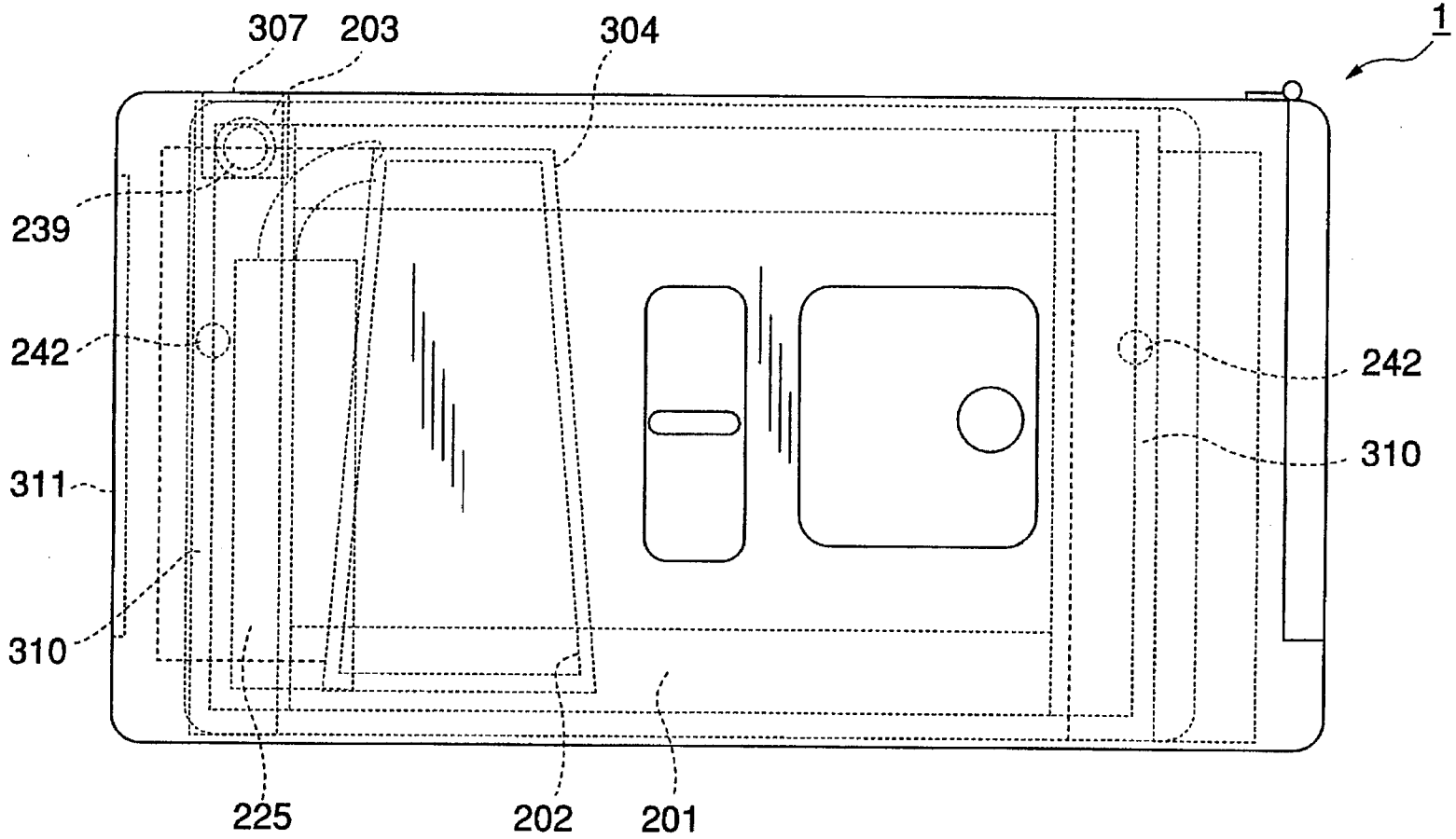
FIG. 7 is a sectional plan view showing the generator set.
Figure 8:
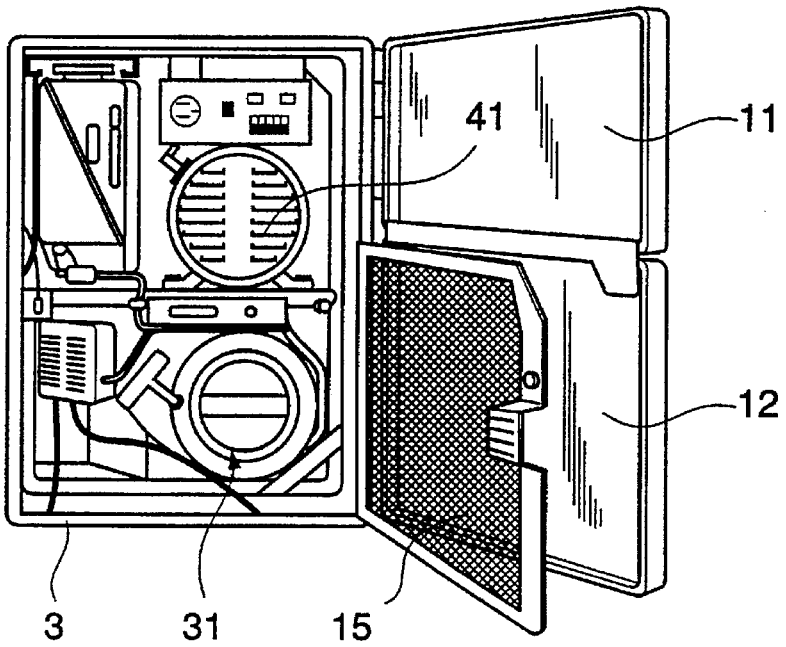
FIG.8 PRIOR ART
FIG. 8 is a front elevational view showing a conventional soundproof engine-driven working machine, with its upper and lower doors being open.
Figure 9:
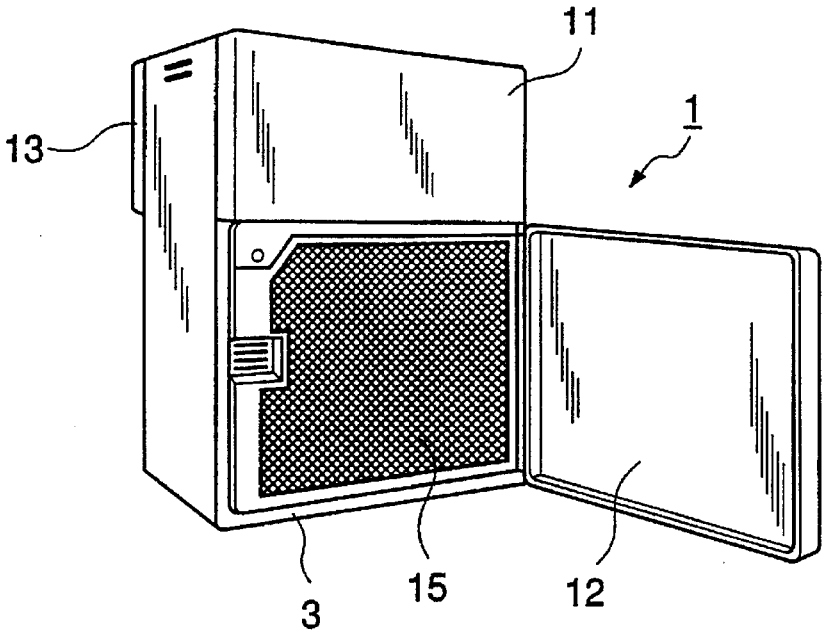
FIG.9 PRIOR ART
FIG. 9 is a perspective view of the FIG. 8 soundproof engine-driven working machine in ah operating state, as viewed from a front side.
Figure 10:
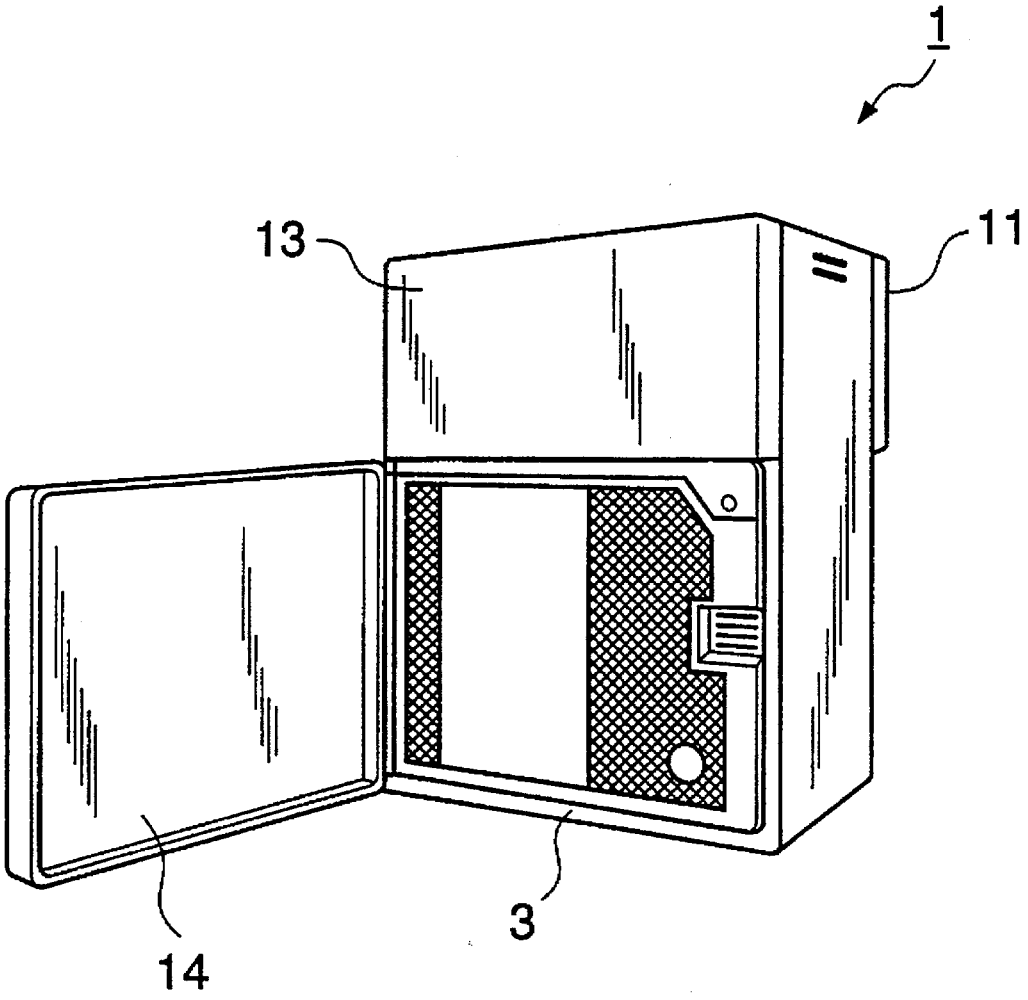
FIG.10 PRIOR ART
FIG. 10 is a perspective view similar to FIG. 9, as viewed from a rear side.

As clearly shown in FIGS. 1 and 7, the duct-connecting member 202 projecting from the top of the engine generator 2 is in the form of a box trapezoidal in shape as viewed in a plan view and progressively reduced in width from a side thereof close to the operator (sidewalk side) to a side thereof remote from the operator (roadway side). Further, as clearly shown in FIG. 7, the communication duct 304 provided in the housing 3 has an air-inlet end portion substantially similar in shape to the duct-connecting member 202 as viewed in a plan view and slightly larger than the same, so that in a state where the engine generator 2 is received in the housing 3 by completely pushing the former into the latter, the duct-connecting member 202 and the air-inlet end of the communication duct 304 communicate with each other in a tightly-connected fashion.

Accordingly, cooling air increased in temperature after cooling the engine generator 2 is positively discharged to the outside via the ducts in a reliable manner without leaking into the housing 3. This ensures constant supply of fresh air into the engine generator 2, thereby making it possible to continue excellent operation of the engine.

In a state where the engine generator 2 is pushed into the housing 3, the engagement of the duct-connecting member 2 with the communication duct 304 causes positioning and fixing the engine generator 2 in place in the direction of advance of the wheels 211. Further, exhaust air is discharged through the cooling air outlet 311 at the rear end of the housing 3 via the duct-connecting member 202 and the communication duct 304. Since the duct-connecting member 202 and the communication duct 304 have respective air-outlet end portions progressively reduced in width from the side close to the operator (sidewalk side) to the side remote from the operator (roadway side), the above-mentioned positioning of the engine generator 2 can be effected with ease, and the speed of flow of cooling air can be made higher on the roadway side than on the sidewalk side, thereby preventing passersby from being exposed to unpleasant exhaust winds increased in temperature through cooling.

The exhaust duct 203 projecting from the top of the engine generator 2 at a location adjacent to the duct-connecting member 202 opens toward the roadway side, as mentioned hereinabove. In a state where the engine generator 2 is received in the housing 2 by completely pushing the former into the latter, as shown in FIG. 7, the opening of the exhaust duct 203 overlap an exhaust port 307 formed in the housing 3, with the bottom opening of the exhaust duct 203 connected to an air-outlet end of a second exhaust pipe 239 extending from the muffler 225.

Therefore, exhaust gases emitted from the engine 213 are reduced in noise by the muffler 225, and discharged via the second exhaust pipe 239, the exhaust duct 203, and the exhaust port 307 to the outside on the roadway side.

As described heretofore, according to the invention, provision of a small space suffices for carrying out the operation of pulling the engine generator 2 out of the housing 3 so as to operate the engine generator 2 as a single unit. Therefore, even if the generator set 1 is installed in a small space, such as between road trees and flower beds along a sidewalk adjacent to a roadway so as to keep it out of the way of passersby, it is possible to pull the engine generator 2 out of the housing 3 when it is to be operated as a single unit.

The engine generator 2 can be operated in a state received within the housing 3, and hence even if the generator set 1 according to the invention is placed on a street as an emergency power source, it is possible to always hold the generator on standby for operation while enduring severe service environmental conditions for a long term. Further, in supplying electric power to a working site far from the location of the generator set 1, it is only required to pull the engine generator 2 out of the housing 3 and move the same to the working site, which dispenses with laying a long electric cable, thereby preventing loss of electric power due to a voltage drop and enabling efficient use of electric power generated by the engine generator 2.

What is claimed is:

1. A generator set comprising:

a portable engine generator having wheels for moving said portable engine generator;

a permanent soundproof housing for housing said portable engine generator in a manner such that said portable engine generator can be operated therein; and generator takeout means for taking said portable engine generator out of said permanent soundproof housing by permitting said portable engine generator to be pulled out of said permanent soundproof housing in a direction transverse to a direction of advance of said wheels, and thereafter permitting said portable engine generator to move in said direction of advance of said wheels.

2. A generator set according to claim 1, wherein said generator takeout means comprises a truck on which said portable engine generator is placed, said truck being received in said permanent soundproof housing in a manner such that said truck is movable in said direction transverse to said direction of advance of said wheels to allow pulling out of said permanent soundproof housing, and a door having an inner surface and provided in said permanent soundproof housing in a manner such that it can be opened by being downwardly rotated into a horizontal position, whereby said portable engine generator is made movable in said direction of advance of said wheels when said portable engine generator is pulled out of said permanent soundproof housing onto said inner surface of said door in said horizontal position.

3. A generator set according to claim 2, wherein said truck has front and rear ends as viewed in said direction of advance of said wheels, said generator takeout means including contact members provided respectively on said front and rear ends of said truck, and guide members provided in said permanent soundproofing housing and disposed to be brought into contact with respective ones of said contact members, said guide members guiding respective ones of said contact members in said direction transverse to said direction of advance of said wheels as said portable engine generator is pulled out of said permanent soundproof housing.

4. A generator set according to claim 2, including a soundproof casing having a top, in which said portable engine generator is housed, said soundproof casing having an exhaust duct for discharging exhaust air, and wherein said permanent soundproof housing has an exhaust port formed therein and opening into an outside thereof, and a communication duct communicating with said exhaust port, said exhaust duct of said portable engine generator and said communication duct of said permanent soundproof housing being disposed to communicate with each other in a tightly-connected fashion when said portable engine generator is received in said permanent soundproof housing and fixedly positioned therein.

5. A generator set according to claim 4, wherein said exhaust duct of said portable engine generator is formed in said soundproof casing in a fashion projecting out of said top of said soundproof casing, said exhaust duct having a cross-section progressively reduced in width in a direction opposite to said direction transverse to said direction of advance of said wheels in which said portable engine generator is pulled out of said permanent soundproof housing, said communication duct of said permanent soundproof housing having a cross-section substantially similar in shape to said cross-section of said exhaust duct, said exhaust duct and said communication duct being brought into engagement with each other when said portable engine generator is pushed into said permanent soundproof housing, to thereby permit positioning of said wheels in said direction of advance of said wheels.

6. A generator set according to claim 2, wherein said generator takeout means includes rails provided on said truck for receiving said wheels of said portable engine generator therein to guide said wheels in said direction of advance of said wheels.

7. A generator set according to claim 6, including a soundproof casing having a top, in which said portable engine generator is housed, said soundproof casing having an exhaust duct for discharging exhaust air, and wherein said permanent soundproof housing has an exhaust port formed therein and opening into an outside thereof, and a communication duct communicating with said exhaust port, said exhaust duct of said portable engine generator and said communication duct of said permanent soundproof housing being disposed to communicate with each other in a tightly-connected fashion when said portable engine generator is received in said permanent soundproof housing and fixedly positioned therein.

8. A generator set according to claim 7, wherein said exhaust duct of said portable engine generator is formed in said soundproof casing in a fashion projecting out of said top of said soundproof casing, said exhaust duct having a cross-section progressively reduced in width in a direction opposite to said direction transverse to said direction of advance of said wheels in which said portable engine generator is pulled out of said permanent soundproof housing, said communication duct of said permanent soundproof housing having a cross-section substantially similar in shape to said cross-section of said exhaust duct, said exhaust duct and said communication duct being brought into engagement with each other when said portable engine generator is pushed into said permanent soundproof housing, to thereby permit positioning of said wheels in said direction of advance of said wheels.

9. A generator set according to claim 6, wherein said truck has front and rear ends as viewed in said direction of advance of said wheels, said generator takeout means including contact members provided respectively on said front and rear ends of said truck, and guide members provided in said permanent soundproofing housing and disposed to be brought into contact with respective ones of said contact members, said guide members guiding respective ones of said contact members in said direction transverse to said direction of advance of said wheels as said portable engine generator is pulled out of said permanent soundproof housing.

10. A generator set according to claim 9, including running boards formed separately from said rails, for guiding said portable engine generator having been pulled out onto said inner surface of said door, to an outside of said generator, as said portable engine generator is moved in said direction of advance of said wheels.

11. A generator set according to claim 6, including running boards formed separately from said rails, for guiding said portable engine generator having been pulled out onto said inner surface of said door, to an outside of said generator, as said portable engine generator is moved in said direction of advance of said wheels.

12. A generator set according to claim 1, including a soundproof casing having a top, in which said portable engine generator is housed, said soundproof casing having an exhaust duct for discharging exhaust air, and wherein said permanent soundproof housing has an exhaust port formed therein and opening into an outside thereof, and a communication duct communicating with said exhaust port, said exhaust duct of said portable engine generator and said communication duct of said permanent soundproof housing being disposed to communicate with each other in a tightly-connected fashion when said portable engine generator is received in said permanent soundproof housing and fixedly positioned therein.

13. A generator set according to claim 12, wherein said exhaust duct of said portable engine generator is formed in said soundproof casing in a fashion projecting out of said top of said soundproof casing, said exhaust duct having a cross-section progressively reduced in width in a direction opposite to said direction transverse to said direction of advance of said wheels in which said portable engine generator is pulled out of said permanent soundproof housing, said communication duct of said permanent soundproof housing having a cross-section substantially similar in shape to said cross-section of said exhaust duct, said exhaust duct and said communication duct being brought into engagement with each other when said portable engine generator is pushed into said permanent soundproof housing, to thereby permit positioning of said wheels in said direction of advance of said wheels.

* * * * *